United States Patent [19]

Grunerud

[11] Patent Number: 4,463,912

[45] Date of Patent: Aug. 7, 1984

[54] MULTI-ROLL DISPENSER

[76] Inventor: Orion L. Grunerud, 2615 Esquire Dr., Boise, Id. 83704

[21] Appl. No.: 477,628

[22] Filed: Mar. 22, 1983

[51] Int. Cl.[3] ..... B65H 67/02; B65H 19/04; B65H 19/08

[52] U.S. Cl. ..... 242/55.42

[58] Field of Search ..... 242/55.2, 55.3, 55.53, 242/55.42

[56] References Cited

U.S. PATENT DOCUMENTS

| | | | |
|---|---|---|---|
| 2,553,389 | 5/1951 | Steiner et al. . | |
| 2,592,246 | 4/1952 | Scogin . | |
| 2,872,125 | 2/1959 | Rial et al. . | |
| 2,908,451 | 10/1959 | Tucker et al. | 242/55.42 |
| 2,991,951 | 7/1961 | Carroll . | |
| 3,168,258 | 2/1965 | Schwartz . | |
| 3,295,777 | 1/1967 | Carroll . | |
| 3,484,052 | 12/1969 | Clarke . | |
| 3,700,181 | 10/1972 | Diring et al. | 242/55.3 |

FOREIGN PATENT DOCUMENTS

| | | | |
|---|---|---|---|
| 2071614 | 9/1981 | United Kingdom | 242/55.53 |

*Primary Examiner*—Stuart S. Levy
*Assistant Examiner*—Leo Peters
*Attorney, Agent, or Firm*—Wells, St. John & Roberts

[57] ABSTRACT

Disclosed is a dispenser for toilet tissue and other similar roll material having a hollow core. The dispenser has a storage container which allows a plurality of rolls to be stored in an end-to-end stack arrangement. The lowest roll can be dispensed by a user through a side opening in the storage container. When the lowest roll is completely used, the user can discharge the roll core by pulling a slide plate outwardly to align an aperture in the slide plate with the used core. The core also drops through a core opening in a pivot plate immediately below the slide plate. The next roll of tissue drops to the slide plate and is supported thereon because it is larger than the core aperture.

The dispenser is filled by releasing a lock means and rotating the storage container into a horizontal position. The horizontal position allows a catch means to be released so that the assembly normally supporting the rolls can be swung out of position thereby allowing new rolls of tissue paper to be inserted through the bottom end of the storage container. A core rod extends from the top end of the storage container in a cantilevered arrangement to align the tissue rolls and to keep the lowest roll from being stolen from the dispenser.

17 Claims, 7 Drawing Figures

MULTI-ROLL DISPENSER

TECHNICAL FIELD

The technical field of this invention is toilet tissue dispensers and other similar dispensers for sheet material which is wound onto hollow cores.

BACKGROUND OF THE INVENTION

The quest for an acceptable toilet paper dispenser has continued for many years and provide a multitude of dispensers having various features and structures. Despite the large number of dispensers which have been produced, none seems to quite adequately perform all the desired functions well.

One problem commonly associated with dispensers used in public restrooms is the need for preventing theft of the toilet paper. Although many locking dispensers have been manufactured, the interaction between the locking system and the dispenser or roll has often made it difficult for the user to easily dispense the tissue paper. The complementary problem is that dispensers should not allow rolls to be easily spun lest someone will spin off large amounts of tissue for use elsewhere or to be mischievously left on the restroom floor for the custodian to clean up. The efficient maintenance of restrooms also requires that individual rolls be completely used before the next roll is available for dispensing. The rolls should also be kept clean and protected from damage while awaiting use.

A particular area of concern to users is the difficulty in removing roll cores in some prior art dispensers. The multitude of systems are shown in the prior art directed to the removal of the roll cores while maintaining the security of any additional rolls stored within the dispenser. Users are also primarily concerned with the availability of additional tissue.

It is also necessary to have a toilet paper dispenser which can be easily loaded and maintained by the custodian. These and other problems are addressed by the current invention, using an original, novel and useful design not heretofore shown in the prior art, some of which is discussed below.

One prior art paper dispenser is shown in U.S. Pat. No. 2,872,125 to Rial, et al. The Rial patent shows a multi-roll dispenser which is loaded from the top and has a post which is mounted on an assembly which tilts forward to allow the roll core to be removed. A somewhat similar arrangement is shown in U.S. Pat. No. 3,295,777 to Carroll.

U.S. Pat. No. 3,484,052 to Clarke discloses a two-roll dispenser having a catch which extends along the core tube and has two detents which engage and hold the bottom of the rolls. The Clarke dispenser has a bottom plate which only allows the used roll cores to drop through.

U.S. Pat. No. 2,592,346 to Scogin shows a multi-roll dispenser having rolls which are stacked with their cores in a transverse position across the dispenser.

Other various dispensers are shown in U.S. Pat. Nos. 2,553,389 to Steiner, et al.; 3,168,258 to Schwartz; and 2,991,951 to Carrol. None of these prior art references shows a dispenser which is similar to the current invention, the novel features of which will be more fully explained in the description of the invention given below.

BRIEF DESCRIPTION OF THE DRAWINGS

A preferred form of the present invention is illustrated in the accompanying drawings in which.

DETAILED DESCRIPTION OF THE PREFERRED EMBODIMENT

In compliance with the constitutional purpose of the Patent Laws "to promote the progress of science and useful arts" (Article 1, Section 8), applicant submits the following disclosure of the invention.

Figure 1:
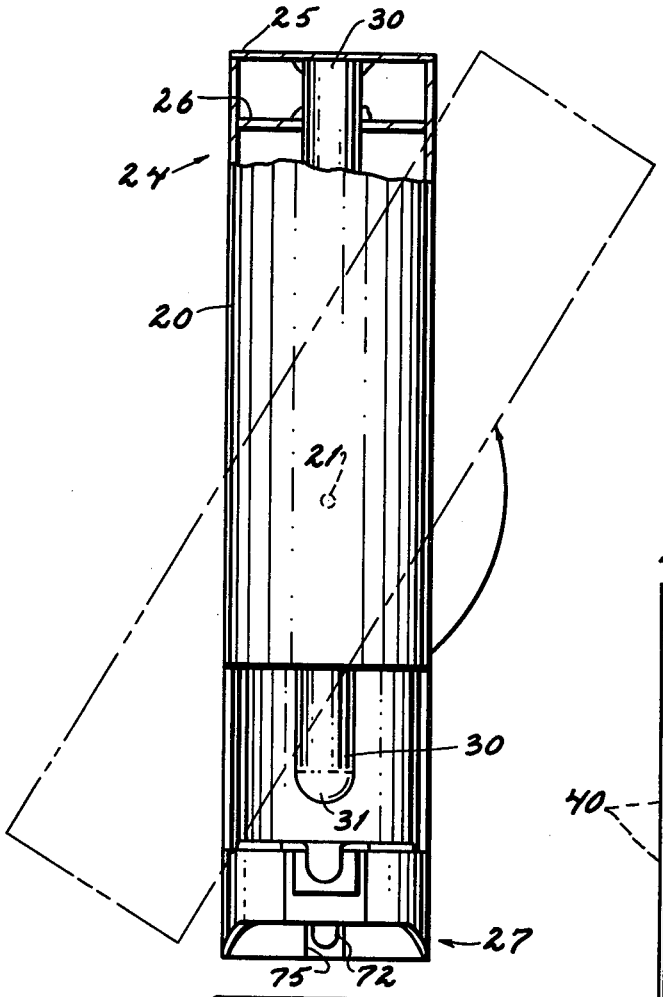
FIG. 1 is a front elevational view of the dispenser with a portion broken away and shown in cross section.
Figure 2:
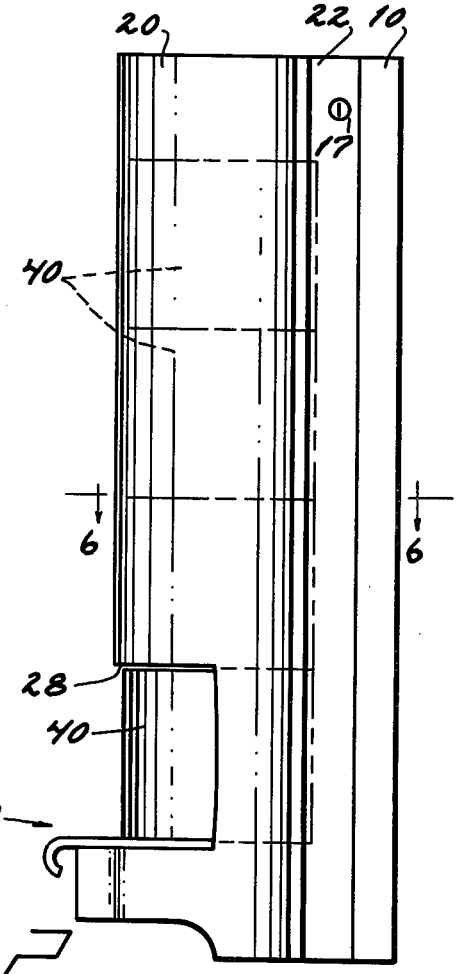
FIG. 2 is a side elevational view of the dispenser shown in FIG. 1 with a stack of rolls shown in phantom.
Figure 3:
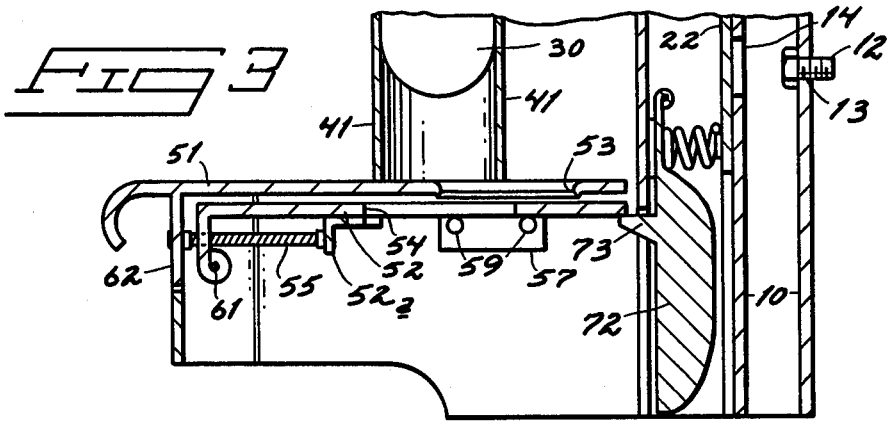
FIG. 3 is a partial cross-sectional view taken along line 3—3 of FIG. 7, an empty roll core has been added and is shown supported upon the slide plate.

A dispenser of this invention is shown in front elevational view in FIG. 1 and in side elevational view in FIG. 2. The dispenser includes a mounting frame 10 which can be attached to a supporting wall (not shown). The mounting frame 10 is preferably a rectangular tubular member as most clearly shown in FIG. 6. Mounting frame 10 is attached to a supporting wall using fasteners 12 which extend through apertures 13 (FIG. 3). Access aperture 14 is provided so that the fastener 12 can be installed through aperture 13.

Mounting frame 10 is preferably installed upon a supporting wall in a vertical orientation. The supporting wall is also preferably vertical, although variation in the wall and in the orientation of the dispenser are possible while still allowing the dispenser to operate.

Figure 6:
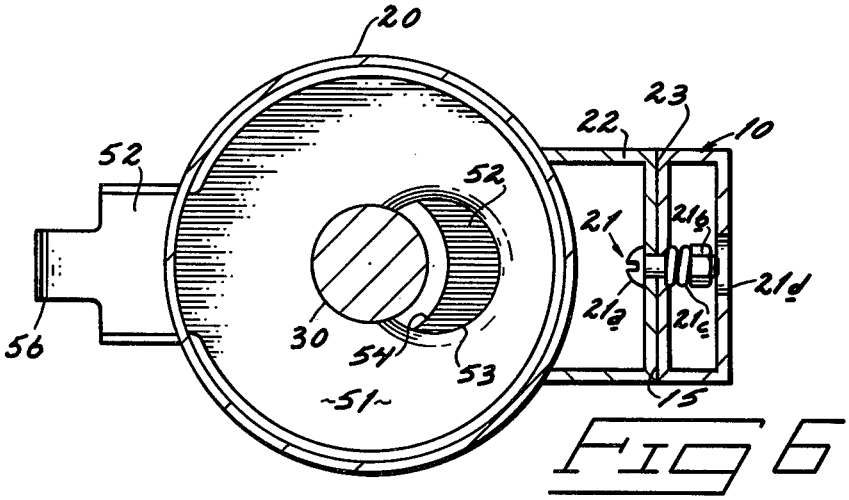
FIG. 6 is a cross-sectional view taken along line 4—4 of FIG. 2. The rolls shown in phantom in FIG. 2 have been removed to better show the support assembly components.

A storage container 20 is preferably pivotally mounted to the mounting frame 10 at pivot 21 (FIG. 1 and FIG. 6). FIG. 6 shows that pivot 21 comprises a bolt **21*a*, nut 21*b* and spring 21*c*. Opening 21*d* allows the pivot to be assembled. Storage container 20 can advantageously include container frame work 22 having a flat contact surface 23, which bears upon the contact surface 15 of mounting frame 10**.

Storage container 20 is preferably cylindrical to appropriately accommodate the cylindrical rolls of toilet tissue or other rolled material. Alternative cross-sectional shapes, such as square, could also be used. Storage container 20 also preferably has an enclosed top end plate 25 as shown in FIG. 1, to keep dust and dirt from entering. Enclosed top end plate 25 also preferably helps to support the core rod 30.

Core rod 30 is mounted only at the top end 24 of storage container 20 using the top plate 25 and a cantilever plate 26. This cantilever mounting arrangement for core rod 30 allows rolls to be easily inserted through the substantially open bottom end 27 of storage container 20. Core rod 30 extends through the hollow cores of rolls 40. Core rod 30 is preferably provided with a rounded end 31 to facilitate loading of the tissue rolls 40. The end of core 30 extends downwardly below the top of side opening 28 to prevent theft of the lowest roll.

Storage container 20 is preferably provided with a side opening 28 which allows tissue to be removed from the lowest roll. Storage container 20 can also advantageously be provided with a lock means 17 which locks the storage container 20 and container frame 22 with respect to the mounting frame 10, thereby preventing theft of rolls from the dispenser, as will be explained more fully below.

Figure 7:
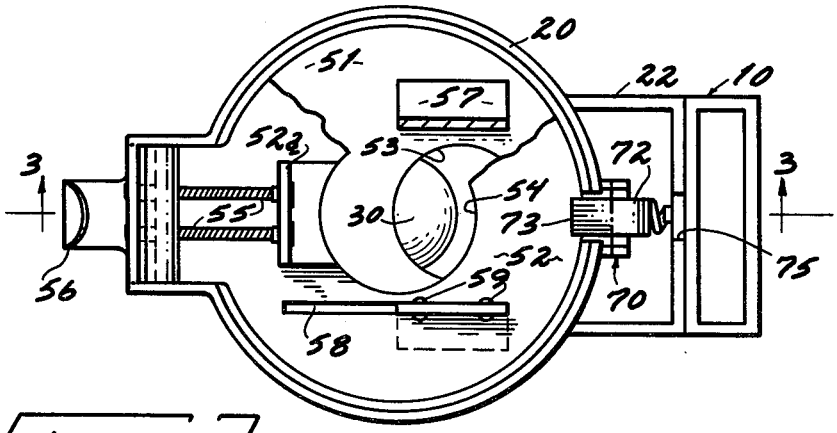
FIG. 7 is a bottom view of the dispenser shown in FIGS. 1 and 3 with a portion broken away and shown in cross section.

Rolls 40 are supported upon a support assembly 50 which is attached to storage container 20. FIG. 3 shows the support assembly 50 in greater detail and indicates that support assembly 50 includes a slide plate 51 and a pivot plate 52. Pivot plate 52 is pivotably mounted to container 20 at pivot 61. Slide plate 51 is slidably attached to pivot plate 52 using slide bar 57. Slide bar 57 is rigidly attached to slide plate 51 and extends through slots 58 in the pivot plate 52 (see FIG. 7). Pins 59 extend through slide bar 57 to keep the pivot plate 52 and slide plate 51 in close sliding relationship.

Slide plate 51 is provided with a core aperture 53 and pivot plate 52 is provided with a core opening 54. A spring 55 or other biasing means extends between pivot plate clip **52*a* and slide plate bracket 62 in order to bias the slide plate into the offset position shown in FIG. 3. Biasing means 55 extend through or to the side of pivot plate 52**.

Figure 4:
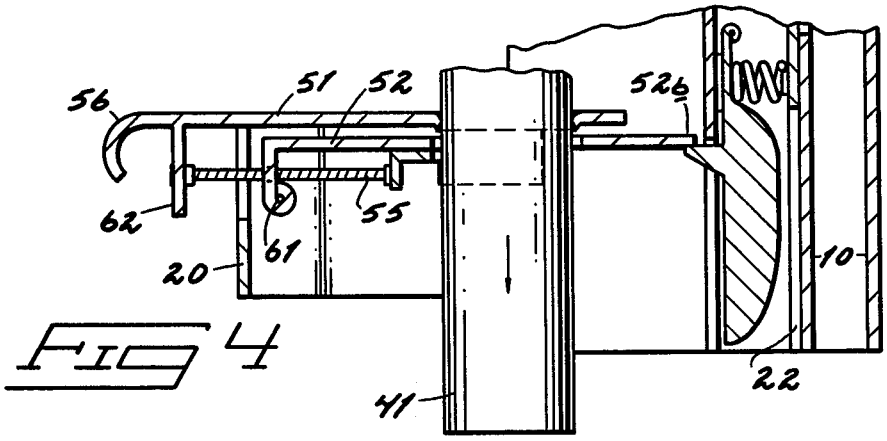
FIG. 4 is a view similar to FIG. 3, except that the slide plate has been pulled outwardly to align the core aperture with the core, thereby allowing it to drop from the dispenser.

FIG. 3 shows a used roll core 41 supported upon slide plate 51 while the slide plate is in the offset position. Core 41 is ready for removal from the dispenser because most or all of the tissue has been removed and it is now of sufficiently small diameter so it will drop through core aperture 53 and core opening 54. FIG. 4 shows slide plate 51 in the core discharge position. The core discharge position is achieved by grasping hook 56 and pulling it and attached slide plate 51 outwardly. In the core discharge position, the core aperture 53 is approximately coaxially aligned with both the longitudinal axis of core rod 30 and core opening 54. This coaxial alignment of aperture 53, opening 54 and core 41 allows the core to drop through the slide plate and pivot plate onto the floor or into a receptacle specifically provided for catching the roll cores.

Figure 5:
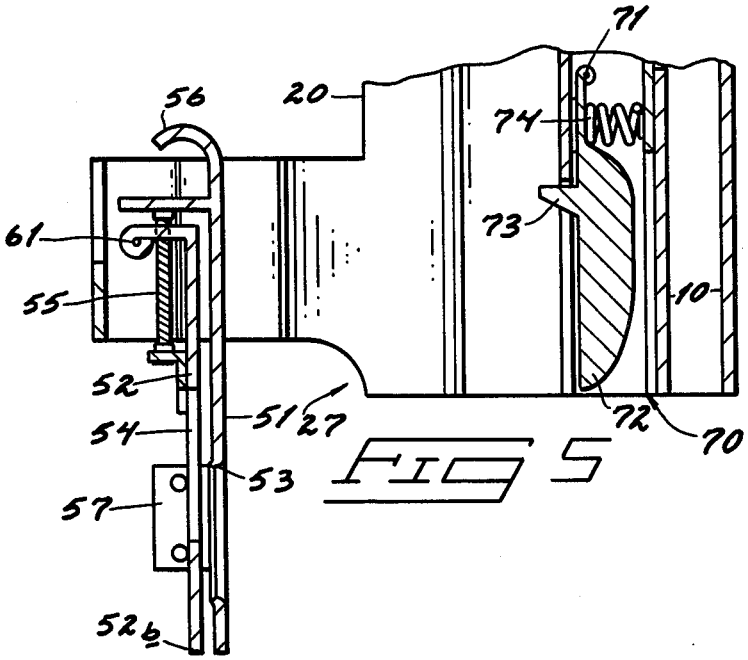
FIG. 5 is similar to FIG. 3, except that the support assembly has been released and rotated into the load position thereby allowing full rolls to be inserted into the storage container.

FIG. 5 shows that the support assembly 50 can be pivoted into a loading position which allows full rolls of toilet tissue to be inserted into the storage container 20 through bottom end 27. A catch means 70 is pivotally attached to the storage container 20 at pivot 71. Catch arm 72 has an engagement point 73 upon which rests a projecting point **52*b* of pivot plate 52. A biasing means such as spring 74 is used to bias the catch arm 72 into the catch position shown in FIG. 3 wherein the engagement point 73 will support pivot plate 52**.

To help prevent theft of toilet tissue from the dispenser, the catch means 70 is preferably constructed so it cannot be released from the catch position when the storage container 20 is in the vertical position shown in FIGS. 1 and 2. This is accomplished by making the catch arm 72 sufficiently deep so that it cannot be pivoted far enough counterclockwise to move projection 73 from beneath pivot plate 52 before the catch arm 72 strikes frame 10. A slot 75 is provided in the storage container framework 22 adjacent to the catch arm 72. When storage container 20 is rotated into a horizontal position, slot 75 allows the catch arm 72 to be pivoted inwardly through slot 75 to a release position, thereby releasing the pivot plate 52. The support plate assembly 50 can then be swung into the loading position shown in FIG. 5. The support plate assembly is returned to the support position of FIG. 3 by pivoting the assembly about pivot 61 until the catch arm engagement point 73 catches the bottom of pivot plate 52.

The manner of installing and using the invention will now be more fully considered. Installation of the dispenser is preferably accomplished by mounting the dispenser upon a vertical wall or other supporting surface in a vertical orientation, using fasteners 12 which are installed at both the top and bottom of the dispenser mounting frame 10. The storage container 20 is attached to mounting frame 10 at pivot 21 during the installation process, but is turned into an approximately horizontal position to allow access to fasteners 12 through apertures 14.

After the dispenser is installed on the wall, it is then desirable to fill the dispenser with rolls of toilet tissue 40 or other rolled material having a hollow core. This is done by first releasing the catch means 70 while the storage container is in a horizontal position or otherwise displaced from the usual vertical dispensing position. With the support assembly 50 swung into the loading position shown in FIG. 5, the full rolls of tissue are inserted into the storage container 20 with the hollow cores of rolls 40 extending over core rod 30. Core rod 30 thus keeps rolls 40 aligned and stacked in an end-to-end stack arrangement. After the requisite number of rolls 40 have been installed into storage container 20, the support assembly 50 is pivoted back and caught in the support position shown in FIG. 3. Support assembly 50 is held in the support position by catch means 70. The storage container 20 is then rotated about pivot 21 into the vertical dispensing position shown in FIGS. 1 and 2. Lock means 17 is then used to securely hold the storage container 20 in the dispensing position.

The user of the toilet tissue or rolled material has access to the lowest roll through side opening 28. Side opening 28 allows the user to dispense tissue from the lowest roll by grasping aind pulling the free end of the tissue paper thereby rotating the roll about core rod 30. The weight of rolls 40 bearing upon the lowest roll creates some friction between the slide plate 51 and the lowest roll. This helps to prevent excessive use of the toilet tissue and also helps to prevent mischievous persons from spinning the roll in order to dispense great lengths of tissue paper.

When approximately all of the tissue has been removed from the lowest roll, it is then necessary to dispense the roll core 41 from the dispenser. This is accomplished by pulling the slide plate 51 outwardly by grasping hook 56 and pulling it outwardly into the core discharge position shown in FIG. 4. When the used core 41 falls from the dispenser the remaining stack of rolls 40 slide downwardly within the storage container 20 guided by core rod 30. The new lowest roll is full size so it is unable to drop through core aperture 53 even if the slide plate 51 has not been released by the user. Slide plate 51 thus supports the remaining stack of rolls and the new lowest roll is available for use through side opening 28. This procedure continues until all the rolls stored within the dispenser have been used, at which time it is necessary for an attendant to refill the storage container in the manner described above.

The dispenser of this invention can be easily constructed by one of ordinary skill in the art using metallic or plastic materials of construction and commonly known manufacturing techniques consistent with the description given herein.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A dispenser for rolls of toilet tissue, paper, or other flexible roller materials wound upon a hollow roll core, comprising:

a mounting frame adapted for rigid attachment to a supporting surface;

a storage container connected to the mounting frame and having a top end and a substantially open bottom end; said storage container also having a side opening near the bottom end; the storage container serving to store a plurality of rolls therein in an end-to-end stack arrangement;

a core rod mounted to the storage container at the top end thereof and extending downwardly through the storage container in a cantilevered arrangement;

a pivot plate pivotally connected to the storage container and pivotable between a support position and a loading position; the pivot plate having a core opening therethrough which is approximately coaxially aligned with the core rod and sufficiently large to allow a roll core to pass therethrough;

a slide plate slidably connected to the pivot plate; the slide plate being positioned above the pivot plate and adjacent to the side opening in the storage container; the slide plate having a core aperture therethrough which is sufficiently large to allow a roll core to pass therethrough; the slide plate being slidable between an offset position wherein the core aperture is offset with respect to the core rod and the core opening in the hinge plate, and a core discharge position wherein the core aperture is aligned with the core opening and core rod to allow a superposed core to drop therethrough and from the dispenser.

2. The dispenser of claim 1 wherein the storage container is pivotally connected to the mounting frame to allow the storage container to be pivoted between a dispensing position and a horizontal position.

3. The dispenser of claim 2 wherein the storage container includes a container framework which is adjacent to the mounting frame and pivotable with respect thereto.

4. The dispenser of claim 2 further comprising a catch means for releasably engaging and holding the pivot plate in the support position; the catch means being unreleasable when the storage container is in the dispensing position.

5. The dispenser of claim 2 further comprising a catch means for releasably engaging and holding the pivot plate in support position, the catch means comprising:

a catch arm pivotally connected to the storage container at a point adjacent to the mounting frame, for engaging and supporting the pivot plate; the catch arm being pivotable between a catch position and a release position, the release position being assumable only when the storage container is pivoted from the dispensing position; and biasing means for biasing the catch lever toward the catch position.

6. The dispenser of claim 5 further comprising a lock means for releasably locking the storage container to the mounting frame when the storage container is in the dispensing position.

7. The dispenser of claim 2 further comprising a lock means for releasably locking the storage container to the mounting frame when the storage container is in the dispensing position.

8. The dispenser of claim 1 wherein the storage container is approximately cylindrical and slightly larger than the rolls being stored therein.

9. The dispenser of claim 1 wherein the core rod is cylindrical with a rounded lower end.

10. The dispenser of claim 1 wherein the core rod is mounted to the storage container by attachment to an enclosed top end plate of the storage container and by attachment to a cantilever plate mounted within the storage container and downwardly adjacent to the enclosed top end plate.

11. The dispenser of claim 1 further comprising a catch means for releasably engaging and holding the pivot plate in the support position.

12. The dispenser of claim 1 further comprising biasing means for biasing the slide plate from the core discharge position toward the offset position.

13. The dispenser of claim 1 wherein the slide plate has a hook thereon to facilitate sliding the slide plate from the offset position to the core discharge position.

14. A dispenser for rolls of paper toilet tissue having hollow cores, comprising:

a mounting frame adapted for rigid attachment to a supporting wall;

an elongate storage container having a container framework which is pivotally connected to the mounting frame and pivotal between a dispensing position and a horizontal position; the storage container having an enclosed top end, substantially open bottom end and a side opening near the bottom end; the storage container serving to store a plurality of rolls therein in an end-to-end stack arrangement;

a cylindrical core rod mounted near the top end of the storage container and extending longitudinally down the storage container in an unsupported cantilevered arrangement;

a pivot plate pivotally connected to the storage container at a point below the side opening; the pivot plate being pivotable between a support position wherein it extends substantially transversely across the storage container, and a loading position wherein it extends longitudinally with the storage container to allow rolls to be inserted thereinto; the pivot plate having a core opening through which roll cores may pass, the core opening being substantially coaxially aligned with the core rod when the pivot plate is in the support position; and a slide plate slidably connected to the pivot plate and pivotable therewith; the slide plate being positioned on top of the pivot plate and near the bottom of the side opening so as to support the stack of rolls thereabove; the slide plate having a core aperture therethrough which is sufficiently large to allow a roll core to drop therethrough; the slide plate being slidable from an offset position wherein the core aperture is offset from the core rod and core opening, and a core discharge position wherein the core aperture is aligned with the core rod and core opening, thereby allowing a superposed core to drop through the slide plate and pivot plate and from the dispenser.

15. The dispenser of claim 14 wherein the storage container is cylindrical to receive cylindrical rolls.

16. The dispenser of claim 14 further comprising:

a catch means for releasably engaging and holding the pivot plate in the support position; the catch means being releasable only when the storage container is pivoted from the dispensing position; and a lock means for releasably locking the storage container in the dispensing position.

17. The dispenser of claim 14 further comprising biasing means to bias the slide plate from the core discharge position toward the offset position.

* * * * *